US011081328B2

(12) United States Patent
Höhndorf et al.

(10) Patent No.: US 11,081,328 B2
(45) Date of Patent: Aug. 3, 2021

(54) MAINTAINING SPECTRAL QUALITY OVER LONG MEASURING PERIODS IN IMAGING MASS SPECTROMETRY

(71) Applicant: Bruker Daltonik GmbH, Bremen (DE)

(72) Inventors: Jens Höhndorf, Bremen (DE); Andreas Haase, Bremen (DE)

( * ) Notice: Subject to any disclaimer, the term of this patent is extended or adjusted under 35 U.S.C. 154(b) by 0 days.

(21) Appl. No.: 16/782,647

(22) Filed: Feb. 5, 2020

(65) Prior Publication Data

US 2020/0258728 A1 Aug. 13, 2020

(30) Foreign Application Priority Data

Feb. 8, 2019 (DE) ..... 102019103147-8

(51) Int. Cl.
*H01J 49/02* (2006.01)
*H01J 49/00* (2006.01)
*H01J 49/16* (2006.01)

(52) U.S. Cl.
CPC ..... *H01J 49/025* (2013.01); *H01J 49/0004* (2013.01); *H01J 49/164* (2013.01)

(58) Field of Classification Search
CPC ..... H01J 49/025; H01J 49/0004; H01J 49/164
See application file for complete search history.

(56) References Cited

U.S. PATENT DOCUMENTS 4,008,388 A 2/1977 McLafferty et al.
5,969,348 A 10/1999 Franzen
7,745,781 B2 6/2010 Steiner
8,193,484 B2 6/2012 Quarmby et al.
2018/0366311 A1 12/2018 Haase

FOREIGN PATENT DOCUMENTS

WO 2017108091 A1 6/2017

OTHER PUBLICATIONS

Oetjen, Janina et al., "Benchmark datasets for 3D MALDI- and DESI-imaging mass spectrometry", Gigascience, vol. 4, 2015.

*Primary Examiner* — Nicole M Ippolito
*Assistant Examiner* — Hanway Chang
(74) *Attorney, Agent, or Firm* — Benoit & Côté Inc.

(57) ABSTRACT

The invention relates to imaging mass spectrometry on thin sample sections, in particular using MALDI, where a high lateral image resolution means that a plethora of mass spectra has to be acquired and the image acquisition runs over many hours. The quality of the mass spectra deteriorates considerably over time in such cases. The invention is based on the finding that the decrease in spectral quality of continuous measurement series over many hours is only partially caused by a decrease in detector gain, and that another significant cause is a decrease in the number of usable ions per ion generating pulse, which is attributable to several phenomena that are difficult to regulate. The invention now proposes to instead regulate only the detector gain, and such that not only the decrease in the detector gain is compensated, but also the decrease in the number of usable ions per ion generating pulse.

13 Claims, 3 Drawing Sheets

MAINTAINING SPECTRAL QUALITY OVER LONG MEASURING PERIODS IN IMAGING MASS SPECTROMETRY

BACKGROUND OF THE INVENTION

Field of the Invention

The invention relates to imaging mass spectrometry on thin sample sections, especially on thin tissue sections, and preferably with ionization by matrix-assisted laser desorption (MALDI), where a high lateral image resolution means that many millions (even hundreds of millions) of individual mass spectra have to be acquired and the image acquisition runs over many hours. The quality of the mass spectra usually deteriorates considerably from one hour to the next in such cases. If no special measures are taken, it is often no longer possible to usefully evaluate mass signals in the mass spectra after a few hours.

Description of the Related Art

The prior art is explained below with reference to a special aspect, particularly time-of-flight mass spectrometry and specifically MALDI time-of-flight mass spectrometry, and additionally on thin tissue sections as thin sample sections in particular. This shall not be understood as a limitation, however. Useful further developments and modifications of what is known from the prior art can also be used above and beyond the comparatively narrow scope of this introduction, and will easily be evident to the expert skilled in the art in this field after reading the following disclosure.

A mass spectrometric image of a thin tissue section shows a complete mass spectrum for each image point, just as a color image contains a color spectrum for each pixel. Mass spectra can be used to help visualize the distributions of specific molecules in a tissue image, for example peptides, lipids, phosphorylated molecules, pharmaceutical agents or even composite markers for unusual tissue states. Such unusual tissue states can relate to specific forms of tissue stress through to carcinogenic degenerations.

The acquisition of a mass spectrometric image of a thin tissue section may take many hours, depending on the size of the thin tissue section or the desired lateral resolution. Acquisition times of 28 hours and longer, sometimes up to 40 hours, are known. The ionization is usually carried out by matrix-assisted laser desorption (MALDI) with precisely focused laser beams from pulsed lasers; the mass spectra for each image point are usually measured in special time-of-flight mass spectrometers. As a rule, 10,000 individual mass spectra per second are thereby acquired, but around 10 to 1,000 individual mass spectra, which all originate from a small area of the thin tissue section, are added together to form a sum spectrum. This small area of the thin tissue section is called a "pixel"; the mass spectrometric tissue image is therefore composed of the mass spectra of the pixels. It is usual to choose square pixels, with edge lengths of roughly 10 micrometers to 200 micrometers. The size of the pixels defines the lateral resolution of the mass spectrometric image.

The pixels are scanned by the laser beam. The laser beam is focused onto the sample, where it forms a so-called "laser spot"; this spot has a diameter which is typically smaller than the pixel size (e.g., five micrometers).

During a long acquisition time of several hours, as is usually the case in imaging mass spectrometry, the spectral quality deteriorates continuously, which is manifested, in particular, in a decrease in the intensity of the mass signals in the mass spectra. Many phenomena can contribute simultaneously to the decrease in spectral quality.

The position of the laser focus can change due to temperature effects, for example; this means that the laser spot diameter on the sample changes, and thus the strength of the ionization. The strength of the ionization is roughly proportional to the sixth power of the laser energy density, which is why even small changes have a correspondingly big effect. Temperature stabilization of the whole mass spectrometer is very complex and still does not eliminate the effect completely, since the mass spectrometer contains local heat sources, such as the turbopumps. It is also helpful to cool the turbopumps, but this does not completely eliminate the effect either.

The laser can also suffer from fatigue, or the average laser energy can fluctuate. Twenty-eight hours of acquisition in conventional operation means two hundred million laser shots, for example, taking into account the time needed to realign the sample support. Methods to extend the service life of pulsed lasers are known, from the publication WO 2017/108091 A1 (PCT/EP2015/080926; A. Haase 2017), for example, but they require additional adaptations to the laser system.

A further effect which can lead to a reduction in spectral quality is based on the vaporization of matrix material from the thin tissue section. Various low-molecular-weight organic acids are used as matrix material to assist the ionization of sample molecules, but all have the disadvantage that they vaporize more or less easily. In the extreme case, the liquid may vaporize almost completely before the end of an acquisition that lasts for hours, with the result that analyte ions are no longer formed at the last sites to be sampled. Selecting matrix substances with extremely low vapor pressures can extend the useful duration of the spectral acquisition, c.f. the work of J. Yang et al., J. Mass Spectrom. 2018; 1-8, which uses aromatic and cinnamyl ketones. The heating up of the sample support which bears the thin tissue sections has to be reduced also. It is likewise helpful to cool any heat sources in the mass spectrometer. The sample support should be designed so as to prevent the sample from heating up too much, or even so as to cool the sample down.

Another effect which leads to a reduction in the spectral quality consists in the fact that, in the ion source, the acceleration diaphragms which draw off the ions generated in pulses in the source and direct them into the flight path of the time-of-flight mass spectrometer can be contaminated by vapor deposition (or even spattering) of matrix and/or sample material and therefore become electrically charged. In modern mass spectrometers for imaging mass spectrometry, the ion sources are easy to replace and clean, but it is not desirable to interrupt the acquisition of a tissue image to do this, because the continuity of the measurement conditions before and after the interruption is doubtful, and thus the homogeneity of the image can be compromised. A longer operating time between cleaning periods can be achieved with a suitable design of the ion source.

There are additionally many more effects which bring about a reduction in the spectral quality. As a further example, the mirror which reflects the laser beam onto the sample for a laser desorbing ionization method can be clouded by vaporizing material that is not drawn off immediately.

A further marked effect is the decrease in gain of the ion detector as a result of aging caused by use. Different types of ion detectors exhibit different rates of aging, so it is possible in principle to select a detector which only ages slowly; but further parameters must be taken into account here, such as the impact on the mass resolution, dynamic measuring range, maximum measuring rate and yet more. It is therefore often not possible to completely prevent the detector from aging.

A mathematical adjustment of the signal amplitude after the spectral acquisition, usually termed normalization, is possible in principle, but cannot completely correct the aforementioned problems, since it has an effect both on the analytical signals which are actually of interest and on the omnipresent background signals, and hence analytical signal peaks, which are already in low abundance at the start of the measurement and become even weaker over the course of the measurement because of the previously explained deterioration in performance, can get lost in the noise and no longer be detectable.

Several methods are, however, known for controlling a decrease in the gain of the ion detector and keeping the gain constant by means of countermeasures. One example of a relatively recent method of controlling detector gain is published in the patent U.S. Pat. No. 8,193,484 B2 (S. T. Quarmby and M. W. Senko, "Method and Apparatus for Automatic Estimation of Detector Gain in a Mass Spectrometer"). Here the measurement data are evaluated during the acquisition of a continuous series of mass spectra such that a change in the gain is identified and compensated by changing voltages at the detector. This method particularly makes use of the fact that the number of ions in a mass signal can be calculated from the variance of measurement data of a mass signal (RSD=relative standard deviation) in accordance with the laws of statistics. The variance is strictly proportional to the square root of the number of ions when all other parameters stay the same. The gain of the detector can be calculated from the ratio of the number of ions in a signal to the measured signal strength, and corrected where necessary.

It should be clearly pointed out, however, that a detector gain which is kept constant makes only a partial contribution to maintaining the spectral quality, since this decrease in quality has a whole range of causes, as was described above. There is therefore an urgent need for a method which allows the decrease in spectral quality during a protracted acquisition of a mass spectrometric image to be compensated.

A further example of a method to regulate the detector gain is disclosed in patent U.S. Pat. No. 7,745,781 B2 (U. Steiner, "Real-time Control of Ion Detection with Extended Dynamic Range"). Its purpose is, however, to extend the dynamic range, i.e., the objective is to record ion signals of widely varying intensity in a mass spectrum by dynamic adjustment of the gain factor, and it does not relate to imaging mass spectrometry, which requires acquisitions of many hours' duration.

SUMMARY OF THE INVENTION

The invention is based on the finding that the decrease in spectral quality in continuous measurement series over many hours is only partially caused by a decrease in detector gain, and that another significant cause is a decrease in the number of usable ions per ion generation pulse (e.g. laser shot). The term "usable ions" is here taken to mean those ions which are generated in the ion source and arrive at the detector without any spatial or temporal disturbance. By means of the measures described in the introduction, such as the selection of a less volatile matrix material for MALDI, cooling or temperature stabilization of the mass spectrometer, laser with a long service life, preventing the charging of the acceleration diaphragms etc., it is possible to ensure that sufficient ions of each ionic species are available in the mass spectrum of a pixel up to the time when the acquisition series ends. However, without compensating measures, the signals can become so small that they can no longer be separated to a sufficient degree from the omnipresent noise.

When optimal components and technologies are selected, the current prior art states that the decrease in spectral quality is distributed over the individual phenomena roughly as follows: decrease in detector gain, or detector aging, around 40% to 60% (e.g. with commercial multi-channel plates as secondary electron multipliers), drop in ion generation due to vaporization of matrix material around 20% to 40% (e.g. with a volatile matrix substance such as 2,5-dihydroxybenzoic acid, which is conventionally used for MALDI), drop in ion generation due to aging of the laser around 5% to 15% (e.g. for commercial neodymium-doped solid-state lasers), decrease due to other phenomena 5% to 15%.

The decrease in ion generation could be compensated by regulating the energy density in the laser spot. Regulation of the energy density of the laser beam has been found to be unsuitable, however, since the mass spectra not only change quantitatively (i.e. with regard to the ion yield), but also qualitatively with the energy density. In particular, the ratio of the ions formed in the plasma to the spontaneously formed fragment ions (by spontaneous decay in the ion source, so-called in-source decay, ISD), changes. Furthermore, the strength of ionization depends to an extremely critical degree on the energy density, so the balance for setting the energy density in the successive laser shots is very difficult to maintain. Any regulation can disturb the carefully created balance in an unpredictable manner.

The invention now proposes to instead regulate the detector gain in such a way that not only the decrease in the detector gain is compensated, but also the decrease in the number of usable ions per generating pulse (e.g. laser shot). Unlike the case described in the cited patent U.S. Pat. No. 8,193,484 B2, it is not just the detector gain that is kept constant, but also the quality and evaluability of the measured mass spectra.

This can be achieved if the amplified ion current signals at the detector output, and preferably their average value, added over a predetermined mass range of the mass spectrum, are kept constant, for example roughly between m/z 500 and 20,000, although narrower ranges have been found to be useful for certain analyte substances, such as m/z 500 and 1,100 for the quite light lipids. It can also be preferable to calculate the total ion count (TIC) over the complete mass spectrum. Furthermore, the spectral acquisition for MALDI applications, which normally masks out large portions of the ion current of the matrix ions, can also include a larger portion of the matrix ions, which essentially have m/z values of up to around 1,000 (including the matrix clusters), since it has been found that the sum of all ion currents, including the ions from the matrix substance, remains more constant over time than only the sum of the ion currents from the substances of a tissue sample, which are the analytes of actual interest.

To counteract a possible decline in spectral quality in the initial period of an imaging measurement for which no evaluable data are yet available, especially within the first five to ten minutes after the start, a particularly preferred embodiment specifies an initial drift for a continuous change of the voltage at the ion detector, which is dimensioned, for example 2.00 to 5.00 millivolts per second, such that no disadvantages for the spectral quality are to be expected, even if the drift is over- or underestimated for the particular measurement, until sufficient measurement data are available to allow the regulation proposed here, which is based on summed ion current signals, to take effect. The detector voltage and thus the detector gain are then changed continually with this drift value.

This regulation of the detector gain to achieve constancy of the spectral quality for a uniform evaluation is then preferably effected by continually monitoring the drift value for the detector voltage and changing it where necessary. There are many possible ways of monitoring this. A sliding average over a few hundred to a few thousand pixels can be formed as the basis for determining a change in the spectral quality, but it is also possible to more simply form a series of averages across a few hundred or a few thousand pixels in each case. The latter shall be called "section averages" here. It is then possible to simply determine the gradient of the sliding average or the section averages and use it for the regulation. A particularly successful step has been found to be the formation of a derivative of the averages as a function of time. A preferred method calculates the differences between successive averages in each case. The variation of these differences forms a curve which resembles a Gaussian distribution about a zero point. When the spectral quality is well regulated, the differences should vary precisely about the zero value; if the center of this Gaussian distribution deviates from zero, the drift value for the detector voltage must be changed accordingly.

Regulating the detector voltage to maintain the spectral quality requires a gentle approach. It is preferably based on changes in the average values of the amplified ion current at the detector output over many pixels, which are acquired over long measuring times and larger sections of the thin section in order to average out changes that are attributable to the different types of tissue in the thin section. Many experiments have shown that stable regulation can be achieved in practice with the measures described here.

BRIEF DESCRIPTION OF THE DRAWINGS

The invention can be better understood by referring to the following figures. The elements in the figures are not necessarily to scale, but are primarily intended to illustrate the principles of the invention (largely schematically).

DETAILED DESCRIPTION

Figure 1:
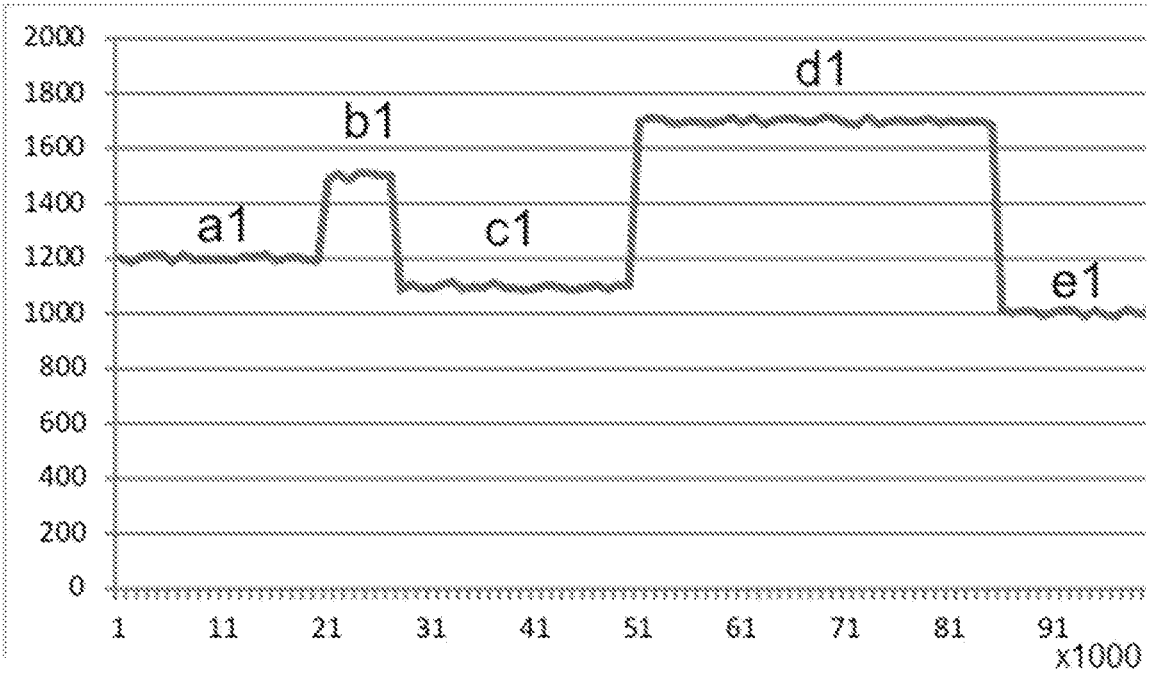
FIG. 1 depicts an idealized ion current curve during a scan across five different types of tissue within a thin section with a good drift value setting for continuous adjustment of the detector voltage (x-axis: #pixel; y-axis: ion current in arbitrary units). The sections a1 to e1 represent the total ion currents as the five different types of tissue are being scanned. The scan duration for the 100,000 pixels of conventional size shown can be assumed to be around one hour.

While the invention has been illustrated and explained with reference to a number of embodiments, those skilled in the art will recognize that various changes in form and detail may be made to it without departing from the scope of the technical teaching defined in the attached patent claims.

As mentioned above, the invention is based on the finding that the decrease in spectral quality is only partially caused by a decrease in the detector gain and quite significantly by a decrease in the number of usable ions per generating pulse (e.g. laser shot) also. The term "usable ions" is here deemed to mean all ions which have been produced in the ion source, e.g. during a laser shot in laser-desorbing ionization methods, and arrive at the detector at the right time, i.e. they generate a signal which can be evaluated. The decrease in the number of usable ions (per laser shot) means that fewer and fewer ions per mass spectrum are measured over the course of the acquisition time. The signal-to-noise ratio steadily decreases: the quality of the spectra, and hence their evaluability, drops continuously. This effect is naturally aggravated by the simultaneous decline in detector gain.

The introduction described measures for a MALDI time-of-flight mass spectrometer in particular which can bring about a situation whereby sufficient numbers of ions of each ionic species are still being generated for every mass spectrum of a pixel at the very end of a long acquisition series (sometimes after over 20 hours). However, without compensating measures, the signals can become so small that they cannot be separated sufficiently well from the omnipresent noise. Such measures consist in selecting a less volatile matrix material and cooling the mass spectrometer, the aim of both measures being to slow down the vaporization of the matrix material. Further measures concern the design of a pulsed laser with a long service life, the design of ion sources which are less susceptible to becoming electrically charged as a result of deposit formation, and stabilization of the high-voltage conditions in the ion optics. Furthermore, suitable designs can also largely reduce the effects of temperature on the focal length of the pulsed laser, and thus on the spot diameter and the energy density in the laser spot. Although measures of this kind are sufficient to provide enough ions per pixel until the end of the acquisition, they usually do not prevent the continuing decline in the evaluability of the associated mass spectra because the signals become smaller and smaller.

The evaluability of the mass spectra can also deteriorate when the mass resolution in the mass spectrum diminishes; in other words, when the mass signals broaden or shift. This can be caused in particular by charging effects on surfaces which are close to the flight path. The mass resolution can be kept largely constant over a wide mass range by applying a method which has become known under the name of "pan" (cf. DE 196 38 577 C1, corresponding to U.S. Pat. No. 5,969,348 A and GB 2 317 495 B). This method uses a time-delayed acceleration of the ions (DE=delayed extraction) followed by a continuous change in the acceleration voltage in time.

In order to keep the quantity of ions generated per laser shot constant, one might have the idea of regulating the energy density in the laser spot. But regulating the energy density of the laser beam in such a way has been found to be unsuitable, since the mass spectra change qualitatively with the energy density. In particular, the ratio of the molecular ions formed in the plasma of the vaporization cloud to the fragment ions formed spontaneously in the surface of the sample (by so-called in-source decay, ISD) changes, and thus also the character of the mass spectra. Furthermore, the strength of the ionization depends to an extremely critical degree on the energy density, so the balance for setting the energy density in the successive laser shots is very difficult to maintain. Any regulation can disturb the carefully created balance of the mass spectrum with regard to the distribution of the analyte ions in an unpredictable manner and thus destroy the homogeneity of a tissue image.

The invention therefore proposes that the detector gain be regulated in such a way that not only the decrease in detector gain is compensated over continuous measurement series lasting for hours, which are required for imaging mass spectrometry of a two-dimensional thin sample section, but also the decrease in the number of usable ions. Unlike the case described in the cited patent U.S. Pat. No. 8,193,484 B2, it is thus not the detector gain which is kept constant, but the quality and evaluability of the measured mass spectra. This sounds very straightforward here, but has been found to be quite essential for the imaging mass spectrometry of larger thin tissue sections or for thin tissue sections for which a very high lateral image resolution is required. This means that a satisfactory signal-to-noise ratio can be maintained right to the end of acquisition series, which take many hours, and the evaluability of the mass signals in the mass spectrum can be kept constant.

This aim of constant evaluability can be achieved if the sum of the amplified ion currents of a mass spectrum, which are measured by the detector and then digitized, is kept constant in the long term across a selected mass range of the mass spectrum, e.g. from around m/z 500 to 1,100 for lipids, as quite light analyte substances.

Most preferable are embodiments in which the total ion count is kept constant over the whole mass spectrum. In a special embodiment, spectral acquisition with the MALDI method, which normally masks out large portions of the ion current of the light matrix ions at the start of the mass range, even includes larger mass ranges of the light matrix ions, usually in the range up to around m/z 1,000, including matrix cluster ions. It has been found that the sum of all the ion currents, including the ions from the matrix substance, remains constant over time, and is therefore more suitable as a controlled variable, than only the current over the ions from the substances of the tissue sample, probably because a greater quantity of matrix ions remains when tissue molecules are ionized to a lesser degree.

The detector gain must be regulated very gently here. Changes caused by different types of tissue in the thin section should be averaged over as large an area as possible. It is therefore preferable to observe the change in the averages of the ion current over long measuring times and larger sections of the thin section. If jumps occur in the averages of the ion currents, these measurements must be rejected for the purpose of regulation. The regulation should be very robust. However, many experiments have shown that such regulation can be achieved with the measures described here.

In a particularly preferred embodiment, an initial drift is specified for a continuous change in the detector voltage, which is dimensioned, for example 0.002 to 0.005 volts per second, such that no disadvantages for the spectral quality are to be expected even if the drift is over- or underestimated, until sufficient measurement data are available to allow the ion current signal regulation proposed here to take effect. The detector voltage is then changed continuously with this drift value. The change in the average of the (total) ion current over several million measured values (thousands of pixels) in each case is then used as the basis for continuously monitoring whether the drift value specified is sufficient for the compensation or needs to be changed. This embodiment has the advantage that the regulation of the detector gain is never abrupt, but that only occasional adjustments of the drift value are necessary.

FIG. 1 depicts an idealized ion current curve during a scan across five different types of tissue within a thin section with a good drift value setting for continuous adjustment of the detector voltage (x-axis: #pixel; y-axis: ion current in arbitrary units). The sections a1 to e1 represent the total ion currents as the five different types of tissue are being scanned. The scan duration for the 100,000 pixels of conventional size shown can be assumed to be around one hour. Within the individual tissue types, the average of the ion currents remains very constant in each case, but exhibits small jumps from one type of tissue to another due to the difference in molecular content. The molecules of certain types of tissue, for example very lipid-rich tissue, are much easier to ionize and therefore supply larger ion currents (e.g. d1). The change in the ion current averages from one type of tissue to another is chosen to be exaggeratedly large here for illustrative purposes. As already noted above, the average of the ion currents from the different types of tissue can remain almost constant over a scan when large sections of the light matrix ions are also measured.

Figure 2:
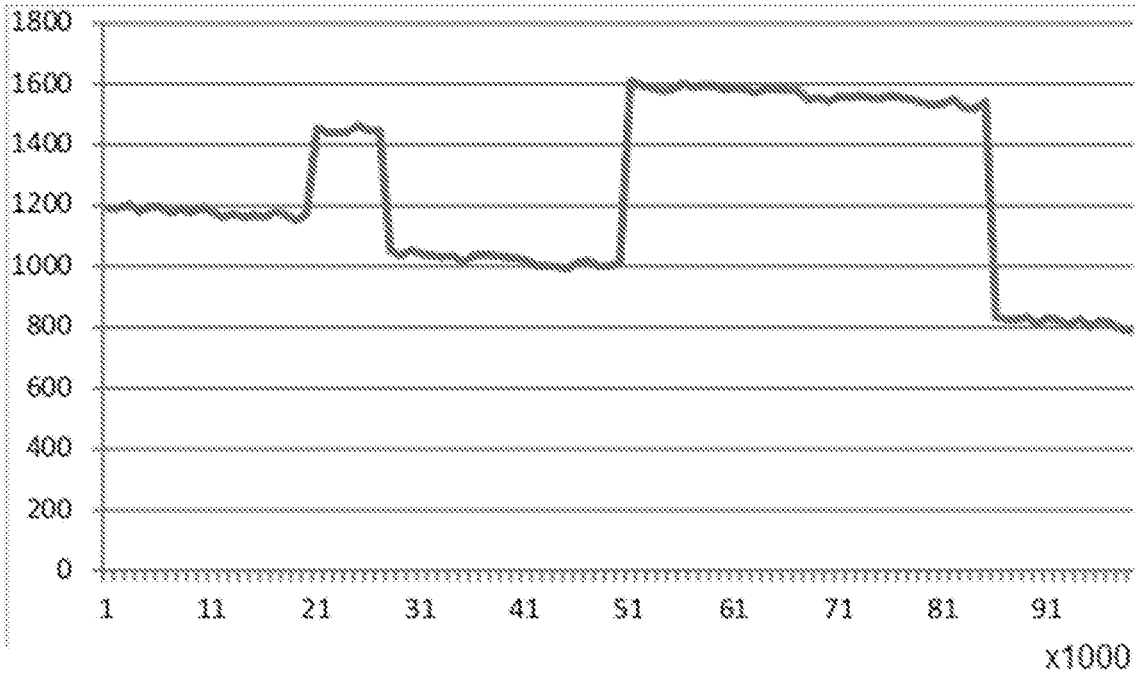
FIG. 2 shows the same initial situation, except that in this case the correction of the detector voltage is not optimal (or there is no correction at all), so the measured ion current decreases continuously, despite the gain being kept constant, for example.

FIG. 2, in contrast, shows a situation in which the correction of the detector voltage is not optimal because, for example, only the change in the gain of a secondary electron multiplier is corrected, or there is no correction at all, so the measured ion current decreases continuously despite this corrective measure. In this case, the detector voltage must be corrected for the ion current drift.

A sliding average over a few hundred to a few thousand pixels can be formed as the basis for determining a change in the spectral quality, but it is also possible to more simply form a series of averages across a few hundred or a few thousand pixels in each case. The latter shall be called "section averages" here.

There are many ways of determining the correction of the drift value for the continuous change in the detector voltage:

For example, it is possible to simply adapt a straight line to the curves of the sliding average or the section averages across each of the sections of a homogeneous type of tissue, and to use its gradient for the regulation, i.e. the gradient along the sections a1, b1, c1, etc. from FIG. 1 or 2. In FIG. 1, the gradient is zero; in FIG. 2, the average values decrease over time. It is preferable to determine each of the sections between the jumps individually to avoid the singularities at the transitions between the different tissue types.

Figure 3A:
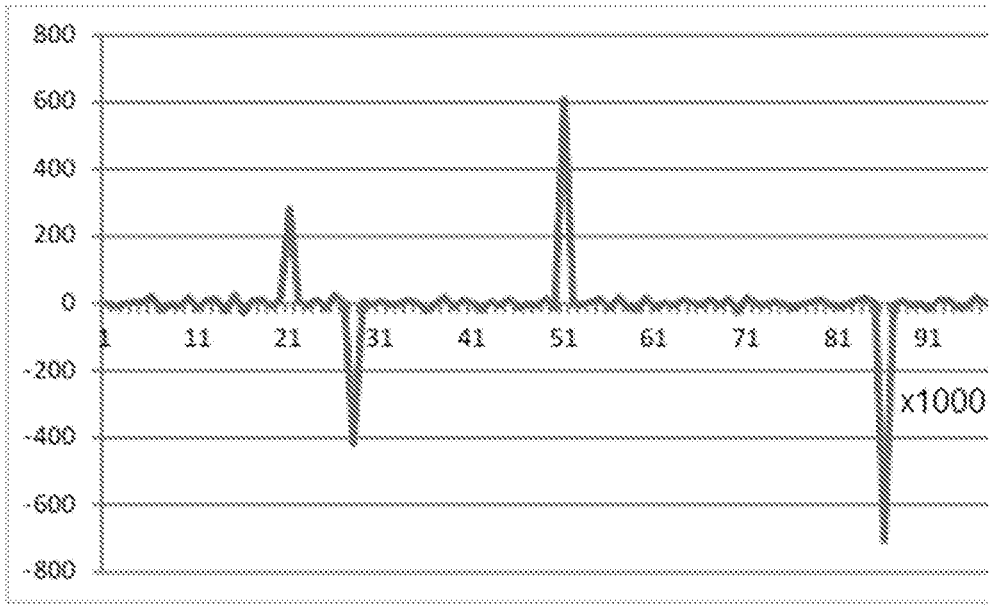
FIG. 3*a* depicts the derivative of the ion current curve from FIG. 1. The derivative was generated by simply forming the differences between successive measured values. Apart from the spikes, which originate from the transitions between the tissue types, the values are distributed precisely about zero.
Figure 3B:
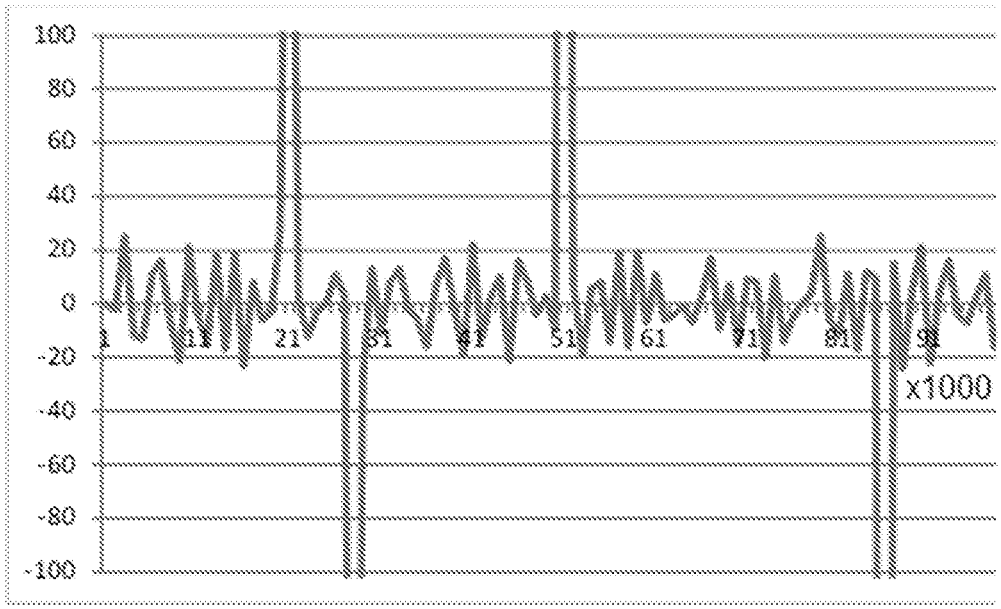
FIG. 3*b* depicts the spread about zero, enlarged by stretching the intensity axis.
Figure 4:
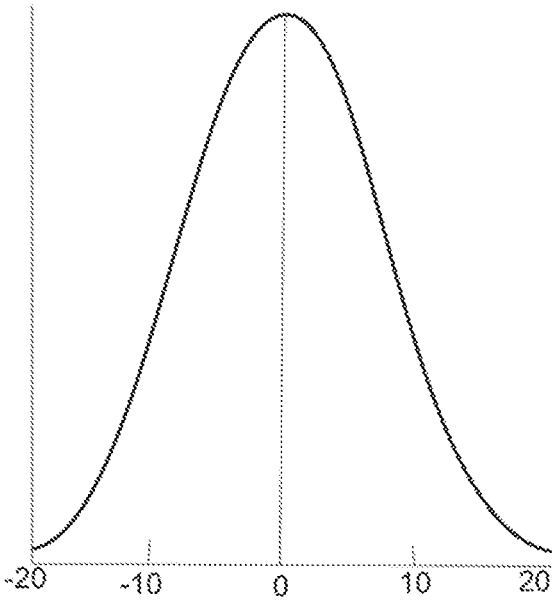
FIG. 4 shows the spread of the measured values from FIGS. 3*a* and 3*b* in a distribution curve. When the spikes are not taken into account, the distribution is Gaussian. The centroid of the Gaussian is precisely zero here, and therefore indicates that the correction of the detector gain is correct.
Figure 5:
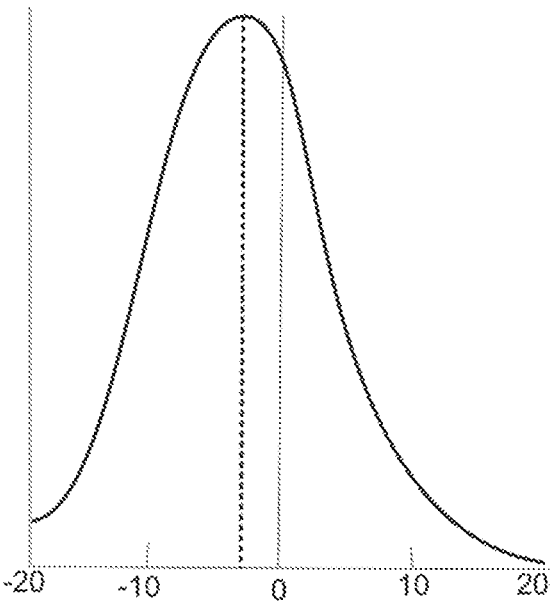
FIG. 5 shows, by way of contrast, the Gaussian distribution as obtained from the measured curve in FIG. 2. The centroid of the distribution is no longer at zero. The deviation of the centroid from zero can be used to calculate a better drift value for the readjustment of the detector voltage.

A particularly successful step has been found to be the formation of a derivative of the averages as a function of time. A preferred method calculates the differences between successive averages in each case, as shown in FIGS. 3*a* and 3*b*. The variation of these differences forms a curve which (ideally) should correspond to a Gaussian distribution about a zero point. When the spectral quality is well regulated, the differences should vary precisely about the zero value; if the center of this Gaussian distribution deviates from zero, the drift value for the detector voltage must be changed accordingly. FIGS. 4 and 5 present such distribution curves of the spreads; FIG. 4 for a well-regulated change in detector voltage, FIG. 5 for a drift value requiring correction.

It is also possible to form the sum of the averages of the ion currents over complete scanning lines in each case, and to use the change over the sequence of scanning lines to correct the ion current drift.

The detector voltage is usually controlled via a digital-to-analog converter. Controllers with depths of 14 to 16 bits are used here to achieve a high control accuracy. Despite the fine control, it is found that changing the control by one unit takes many seconds, in contrast to the example above, i.e. it cannot be done continuously, but only incrementally. It can therefore be advantageous to specify after how many seconds the control is to be changed by one unit and to change this timespan, where necessary.

It has been found that bigger changes in the evaluability occur at the start of the measurements than during the remaining measurement period. The causes for this can be manifold and have not been fully explained. It is therefore advantageous to track these changes separately. These changes can particularly be taken into account by observing the amplified ion currents or their average value(s) over shorter time intervals at the start of the measurement, for example over 10 seconds each instead of several minutes in the middle part and at the end of a measurement period.

The invention has been described above with reference to different, specific example embodiments. It is to be understood, however, that various aspects or details of the embodiments described can be modified without deviating from the scope of the invention. In addition to the MALDI method, other types of pulsed ionization such as SIMS can also be used for the pixel scanning of a thin sample section. Furthermore, mass filters or ion cyclotron resonance mass spectrometers are conceivable as the mass analyzer instead of time-of-flight mass spectrometers. The invention should therefore not be restricted to the examples explained. Furthermore, features and measures disclosed in connection with different embodiments can be combined as desired if this appears feasible to a person skilled in the art. Moreover, the description above serves only as an illustration of the invention and not as a limitation of the scope of protection, which is exclusively defined by the appended Claims, taking into account any equivalents which may possibly exist.

The invention claimed is:

1. A method for imaging mass spectrometry on thin sample sections, from which a large number of mass spectra are continuously acquired in a mass spectrometer with ion detector via a pixel pattern in order to record a distribution of signals in the thin sample sections, where regulating an ion detector voltage enables ion currents, which are measured by the detector across a selected mass range in the mass spectra and summed, to be kept constant at a target value in the long term over the measurement of many mass spectra in order to maintain the quality of the mass spectra over a period of many hours until the end of the measurements.

2. The method according to claim 1, wherein the ionization of molecules of the thin sample section is realized by matrix-assisted laser desorption (MALDI).

3. The method according to claim 2, wherein the ion currents measured include at least a portion of the matrix ions.

4. The method according to claim 1, wherein the mass spectra are acquired by a time-of-flight mass spectrometer, ion cyclotron resonance mass spectrometer, or mass filter.

5. The method according to claim 1, wherein the ion currents measured represent an ion current over the complete mass spectrum (total ion count) or a part of it.

6. The method according to claim 1, wherein a clock-pulse rate of the ion detector voltage regulation has a predetermined value at the start of the measurement and changes to a lower predetermined value over the further course of the measurement.

7. The method according to claim 1, wherein the ion currents are determined by forming averages across several mass spectra.

8. The method according to claim 7, wherein a sliding average is formed across several hundred to several thousand pixels, or wherein a series of averages across several hundred or several thousand pixels ("section averages") in each case is formed.

9. The method according to claim 7, wherein the ion detector voltage is virtually changed continuously with a predetermined temporal drift value during the acquisition of the mass spectra, and the drift value is corrected when the average of the ion currents no longer remains constant over time.

10. The method according to claim 9, wherein a temporal constancy of the ion currents is determined by straight lines, which are applied to curves of the averages and whose gradient is used to calculate drift values.

11. The method according to claim 9, wherein a derivative curve of the curves of the averages is formed by calculating differences between successive averages, wherein a distribution curve of the variances of this derivative curve is formed, and a deviation of the distribution centroid from zero is used to calculate an ion current drift correction.

12. The method according to claim 1, wherein the signals in the thin sample section originate from peptides, lipids, phosphorylated molecules, pharmaceutical agents and/or composite markers for unusual tissue states such as carcinogenic degenerations.

13. The method according to claim 1, wherein an acquisition rate for the mass spectra is in the kilohertz range, while around 10 to 1,000 mass spectra per pixel are added together to form a sum spectrum.

* * * * *